United States Patent [19]

Viertler

[11] 4,288,204

[45] Sep. 8, 1981

[54] SUPPORT FOR MULTI-STAGE COMPRESSORS

[75] Inventor: Albin Viertler, Saarwellingne, Fed. Rep. of Germany

[73] Assignee: Klein, Schanzlin & Becker AG, Frankenthal, Fed. Rep. of Germany

[21] Appl. No.: 14,476

[22] Filed: Feb. 23, 1979

[30] Foreign Application Priority Data

Mar. 2, 1978 [DE] Fed. Rep. of Germany ..... 2808952

[51] Int. Cl.[3] ..... F04B 25/00

[52] U.S. Cl. ..... 417/243; 417/244

[58] Field of Search ..... 417/243, 244; 165/47

[56] References Cited

U.S. PATENT DOCUMENTS 3,644,054 2/1972 Pilarczyk ..... 417/375 X

*Primary Examiner*—Richard E. Gluck

*Attorney, Agent, or Firm*—Peter K. Kontler

[57] ABSTRACT

An aggregate wherein a hollow support carries a multi-stage compressor and one or two heat exchangers. The outlet of the first stage of the compressor communicates with a first chamber of the support by way of a first passage, the first chamber communicates with the inlet of the second stage of the compressor, the outlet of the second stage communicates with the inlet of the next-following stage by way of a second passage and a second chamber in the support, and the outlet of the next-following stage communicates with an outlet opening of the support. Such outlet opening can admit compressed fluid medium to an aftercooler. Each heat exchanger is connected between the outlet of one of the first and second stages and the respective passage, and the next-following stage of the compressor is disposed between the first and second stages. The outlets of the stages are directly connected with channels which are machined into the support and diverge in the direction of flow of fluid medium therethrough.

10 Claims, 6 Drawing Figures

SUPPORT FOR MULTI-STAGE COMPRESSORS

BACKGROUND OF THE INVENTION

The present invention relates to compressors in general, and more particularly to improvements in aggregates wherein a compressor is combined with one or more heat exchangers. Still more particularly, the invention relates to supports or bases for multi-stage compressors which cooperate with one or more heat exchangers.

It is already known to combine a multi-stage compressor with one or more heat exchangers. An aggregate embracing a multi-stage compressor and at least one heat exchanger further comprises means for conveying a fluid between various stages of the compressor and the heat exchanger(s). As a rule (or at least in certain instances), the higher stage or stages of the compressor (as considered in the direction of flow of fluid medium through the compressor) are disposed between the lower stages. For example, if the compressor comprises three stages, the last or third stage is disposed between the first and second stages. When the higher stage or stages are located between the lower stages, the means for conveying fluid between the stages and the heat exchanger(s) must intersect or overlap each other. An additional factor which contributes to complexity of such aggregates is that the inlet slots and outlet openings of various stages of the compressor are accommodated in a small area whereas the passages for the flow of fluid from the outlet openings to the heat exchanger or heat exchangers and from the heat exchanger(s) to the inlet slots must have a relatively large cross-sectional area. Therefore, presently known aggregates are not mounted on a common base or support. The connections between the compressor stages and the heat exchanger(s) include a plurality of conduits which contribute to complexity, cost and space requirements of a conventional aggregate. The cost of assembling the aggregate is very high, especially since its components cannot be fully assembled in the manufacturing plant. Thus, the aforementioned conduits must be installed at the locale of use. Such conduits provide relatively long paths for the flow of fluid to be compressed which entails substantial losses in energy. Moreover, the length of conduits varies in response to changes in temperature whereby the compressor (especially the outlet diffusors) is subjected to pronounced stresses which can result in damage to or destruction of certain parts

OBJECTS AND SUMMARY OF THE INVENTION

An object of the invention is to provide a novel and improved base or support which can define and/or accommodate all connections or paths between a multi-stage compressor and one or more heat exchangers.

Another object of the invention is to provide a base or support which is constructed and assembled in such a way that the conduits which are needed in heretofore known compressor-heat exchanger aggregates can be dispensed with.

A further object of the invention is to provide a base or support which defines and/or contains all fluid conveying paths between a multi-stage compressor and one or more heat exchangers, even in those aggregates wherein the higher stage or stages of the compressor are flanked by lower stages.

An additional object of the invention is to provide an aggregate which includes a multi-stage compressor, one or more heat exchangers and a common base or support for the compressor and heat exchanger(s), and which can be fully assembled in the manufacturing plant.

Another object of the invention is to provide a base or support which is relatively simple, compact and inexpensive and which can carry a multi-stage compressor and one or more heat exchangers.

The invention is embodied in an aggregate wherein a compressor (e.g., a three-stage compressor) for a fluid medium (particularly a gaseous fluid) includes a series of successive stages and is connected with at least one heat exchanger means which serves to cool the fluid medium during flow between two successive stages, wherein a next-following stage of the series (i.e., the third stage if the compressor comprises three stages) is disposed between first and second preceding stages (as considered in the direction of flow of fluid medium through the compressor), and wherein each stage of the compressor and each heat exchanger means has an inlet and an outlet.

In accordance with a feature of the invention, the aggregate further comprises a hollow support (e.g., a metallic base which is mounted on the ground or on the floor and is disposed at a level below the compressor) which carries the compressor and the heat exchanger means. The support includes a partition and has first and second chambers disposed at the opposite sides of the partition and respectively interposed between the outlet of the first stage and the inlet of the second stage and between the outlet of the second stage and the inlet of the next-following stage. The support is further formed with first and second passages which are respectively interposed between the outlet of the first stage and the first chamber and between the outlet of the second stage and the second chamber. The one heat exchanger means is connected between the outlet of one of the first and second stages and the respective (first or second) passage.

The support includes first and second walls (e.g., two walls located at the opposite sides of the partition and inclined in opposite directions) which respectively separate the first and second passages from the first and second chambers. The two walls are preferably remote from each other, i.e., the two passages are preferably spaced apart from and face each other and cannot directly communicate with each other.

The novel features which are considered as characteristic of the invention are set forth in particular in the appended claims. The improved aggregate and its support, however, both as to their construction and the mode of operation of the aggregate, together with additional features and advantages thereof, will be best understood upon perusal of the following detailed description of certain specific embodiments with reference to the accompanying drawing.

DESCRIPTION OF THE PREFERRED EMBODIMENTS

Figure 1:
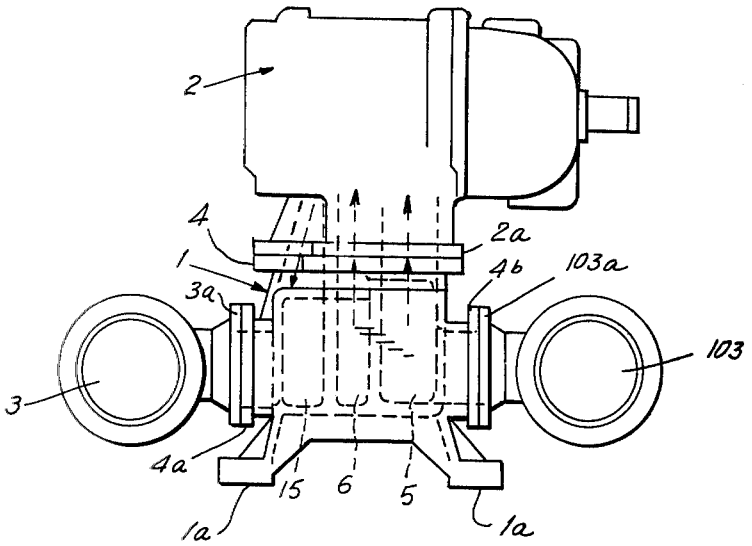
FIG. 1 is a side elevational view of an aggregate including a three-stage compressor, two heat exchangers and a base or support which embodies the invention.
Figure 2:
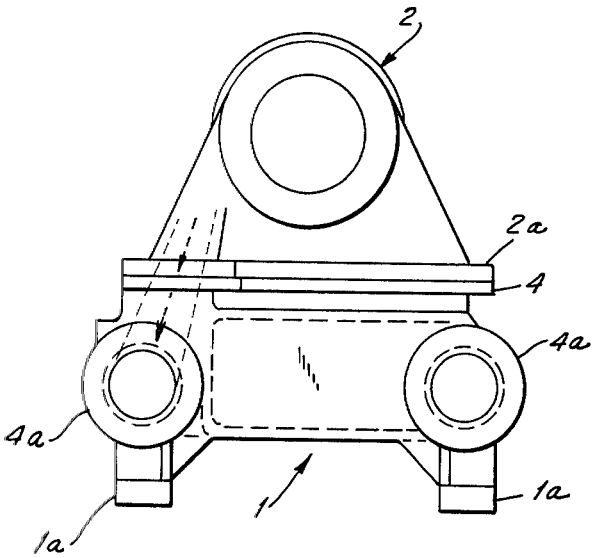
FIG. 2 is an end elevational view as seen from the left-hand side of FIG. 1, with the heat exchangers omitted.

The aggregate which is shown in FIG. 1 comprises a base or support 1 for a multi-stage compressor 2 and two conventionally constructed heat exchangers 3, 103. The support 1 comprises several ground- or floor-contacting legs 1*a*, a top flange 4 which is bolted to a flange 2*a* of the housing of the compressor 2, and two pairs of lateral flanges 4*a*, 4*b* which are bolted to the flanges 3*a*, 103*a* of the respective heat exchangers 3, 103. The compressor 2 is of a conventional multi-stage construction which forms no part of the present invention and, consequently, will not be discussed here. In the arrangement discussed below, the compressor 2 has three stages each of which has an inlet and an outlet which are merely indicated in broken lines in FIGS. 1 and 2. The heat exchangers are omitted in FIG. 2.

Figure 3:
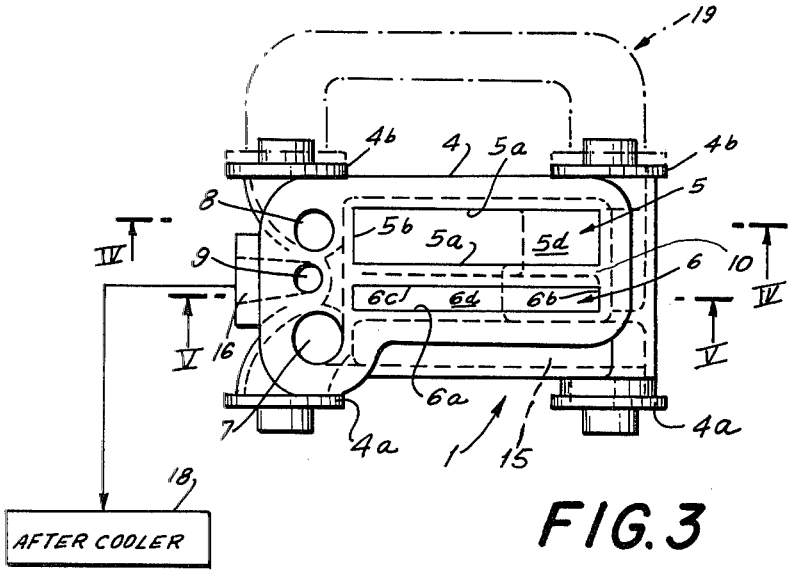
FIG. 3 is a plan view of the support.

As shown in FIG. 3, the flange 4 surrounds the upper portions of downwardly extending chambers 5 and 6 which are respectively in communication with the inlets of second and third stages of the compressor 2. Moreover, the flange 4 surrounds the upper portions of channels 7, 8 and 9 which are respectively disposed below and communicate with the outlets of the first, second and third compressor stages. The exact design of the heat exchangers 3 and 103 forms no part of the invention. The compressor 2 is of the type wherein the last (third) stage is flanked by two lower (first and second) stages. It will be noted that the channel 9 which is connected with the outlet of the third compressor stage is disposed between the channels 7 and 8 which respectively communicate with the outlets of the first and second stages.

Figure 4:
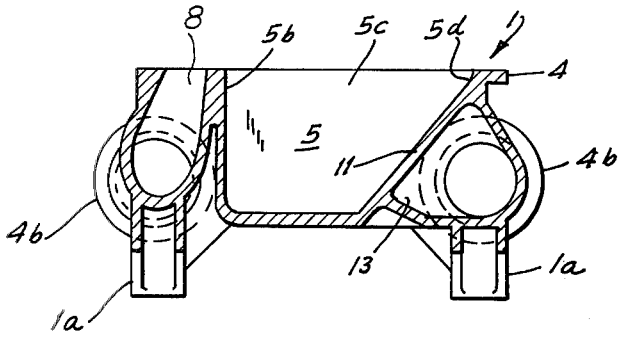
FIG. 4 is a vertical sectional view of the support below the second compressor stage as seen in the direction of arrows from the line IV—IV of FIG. 3.

The chambers 5 and 6 are separated from each other by a vertical partition 10. The sides of each of these chambers are bounded by three vertical or substantially vertical surfaces and by an inclined surface. The vertical surfaces which bound the sides of the chamber 5 are indicated at 5*a*, 5*b* and 5*c*, and the inclined surface 5*d* is defined by a wall 11 which is shown in FIG. 4. The vertical surfaces which bound the sides of the chamber 6 are shown at 6*a*, 6*b*, 6*c*, and the inclined surface 6*d* which bounds a portion of the chamber 6 is defined by an inclined wall 12. The walls 11 and 12 form parts of the support 1, and these walls are spaced apart from each other and are inclined in opposite directions (compare FIGS. 4 and 5).

The support 1 further defines a passage 13 which is disposed below the inclined wall 11, and a passage 14 which is disposed below the inclined wall 12. The chambers 5 and 6 respectively communicate with the passages 13 and 14 by way of ports or holes provided in the partition 10. The outlets of the heat exchangers 3, 103 are respectively connected with the passages 14 and 13. The outlet of the heat exchanger 103 whose inlet receives fluid from the second stage of the compressor 2 discharges directly into the passage 13. The outlet of the heat exchanger 3 communicates with the passage 14 via bypass 15. The support 1 is further formed with an outlet opening 16 which discharges compressed fluid. The channels 7–9 are curved, namely, the channel 7 is curved toward the inlet of the heat exchanger 3, the channel 8 is curved toward the inlet of the heat exchanger 103, and the channel 9 is curved toward the outlet opening 16. The first stage of the compressor 2 supplies fluid to the heat exchanger 3 which supplies fluid to the second stage, the second stage supplies fluid to the heat exchanger 103 which supplies fluid to the third stage, and the third stage supplies fluid to the outlet opening 16.

Figure 5:
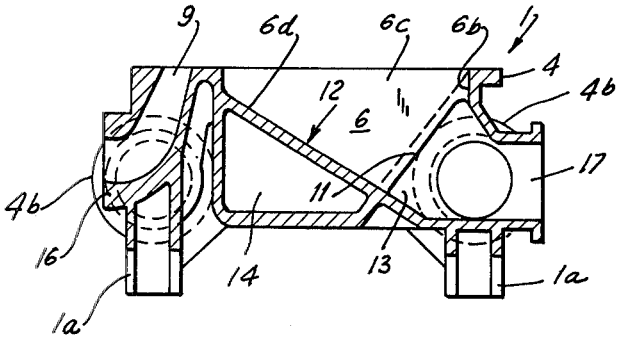
FIG. 5 is a vertical sectional view of the support below the third compressor stage as seen in the direction of arrows from the line V—V of FIG. 3.

If the compressor on the support 1 comprises or is combined with an intermediate cooler and the aftercooler, the passage 13 communicates with a fluid-withdrawing aperture 17 which is shown in FIG. 5. FIGS. 3, 4 and 5 show that the cross-sectional areas of the channels 7, 8 and 9 increase downwardly, i.e., in a direction away from the flange 4 at the top of the support 1.

Figure 6:
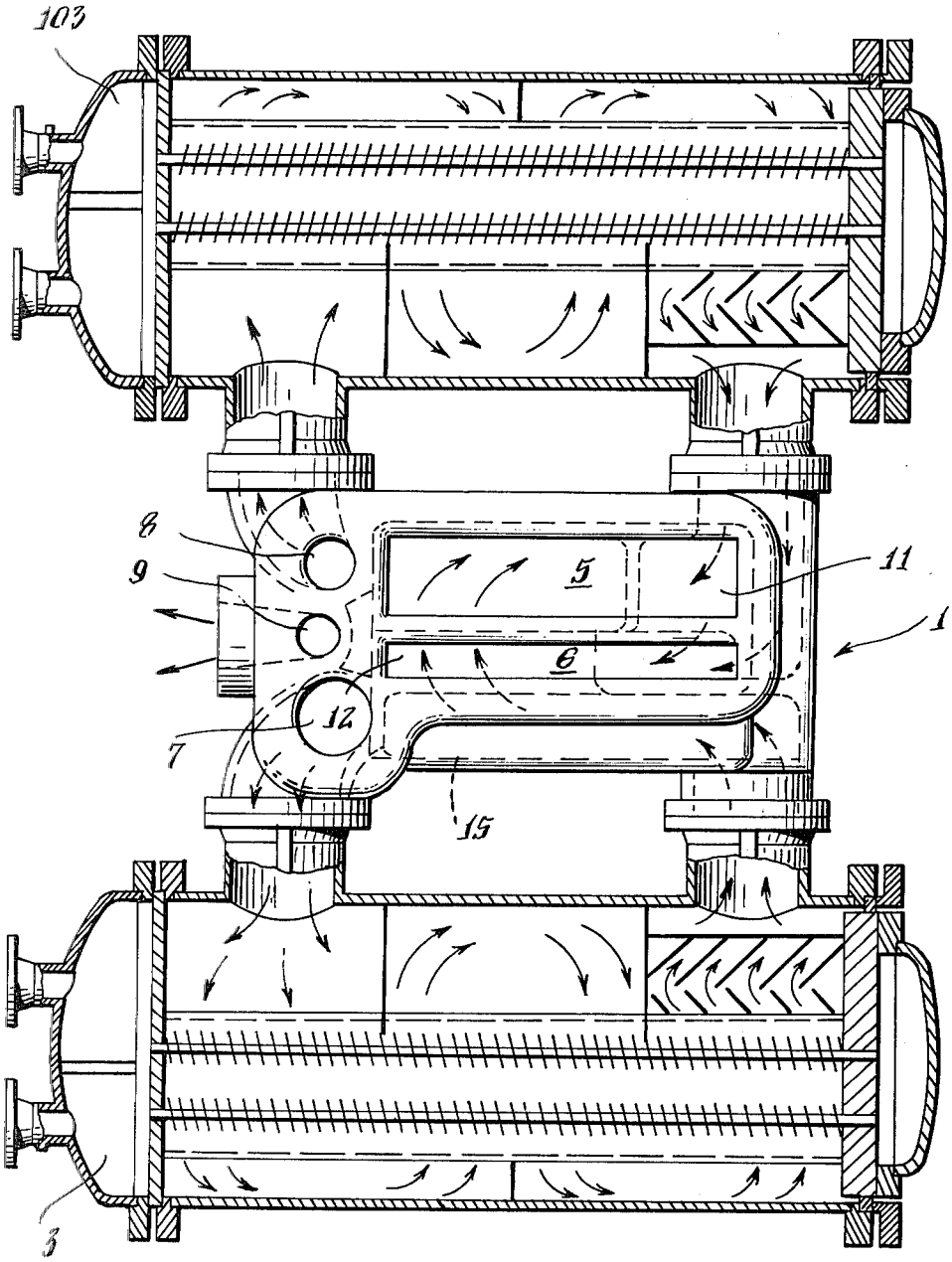
FIG. 6 is a view similar to FIG. 3 but showing the support as assembled with the heat exchanger.

The operation, which will now be discussed particularly with reference to FIG. 6 showing the aggregate in top plan view with only the compressor 2 being omitted, is as follows.

The fluid medium (e.g., a gas) which issues from the outlet of the first stage of the compressor 2 flows through the channel 7 and enters the inlet of the heat exchanger 3. The outlet of the heat exchanger 3 supplies the fluid medium to the bypass 15 which delivers the fluid medium into the passage 14 separated from the chamber 6 by the inclined wall 12. The passage 14 admits the fluid medium into the chamber 5 whence the fluid medium enters the inlet of the second stage of the compressor 2. The outlet of the second stage supplies fluid medium into the channel 8 and thence to the inlet of the heat exchanger 103. After leaving the outlet of the heat exchanger 103, the fluid medium flows via passage 13 separated from the chamber 5 by the inclined wall 11 and via chamber 6 to enter the inlet of the third compressor stage. The outlet of the third stage supplies compressed fluid to the channel 9 which communicates with the outlet opening 16 of the support 1. An aftercooler (schematically shown in FIG. 3, as at 18) can be connected with the outlet 16.

An important advantage of the support 1 and of the aggregate which embodies the support is that the entire aggregate constitutes a compact unit whose space requirements are a fraction of space requirements of conventional aggregates including a multi-stage compressor and one or more heat exchangers. Moreover, the conduits which are necessary in conventional aggregates can be omitted and the assembling of the aggregate can be completed in the manufacturing plant. If the components of the aggregate are shipped separately, the assembly at the locale of use merely involves attachment of the compressor 2 to the flange 4 and attachment of heat exchangers 3, 103 to the respective pairs of flanges 4*a* and 4*b*. Still further, the paths for the flow of fluid medium between the compressor and the heat exchangers are short so that energy losses are a small fraction of such losses in conventional aggregates. Also, and since the connections between the compressor and the heat exchangers do not include pipes, tubes, hoses or analogous conduits, the compressor is not subjected to deforming and/or other stresses which invariably arise when the length of conduits increases or decreases in response to temperature changes.

The feature that the cross-sectional areas of channels 7 and 9 increase in a direction downwardly and away from the flange 4 is desirable and advantageous because such channels act not unlike diffusors and augment the effect of diffusors at the outlets of the compressor stages. It is preferred to design the support 1 in such a way that the cross-sectional area of each channel increases gradually and continuously all the way from the flange 4 and on to the discharge end of the respective channel.

The provision of aperture 17 (shown only in FIG. 5) which communicates with the passage 13 renders it possible to employ the support 1 in combination with a multi-stage compressor. If the aggregate employs a single heat exchanger, the connections to and from the other heat exchanger can be bridged by a suitable conduit 19 indicated in FIG. 3 by phantom lines. Each of the heat exchangers which are shown in the drawing serves to reduce the temperature of fluid prior to entry of such fluid into the next stage of the compressor 2. A compressor which can be utilized in the aggregate of the present invention is disclosed in U.S. Pat. No. 3,644,054, granted Feb. 22, 1972 To Pilarczyk.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In an aggregate wherein a compressor for a fluid medium includes a series of successive stages and is connected with at least one heat exchanger means, wherein a next-following stage of said series, as considered in the direction of flow of fluid medium through the compressor, is disposed between first and second preceding stages and therein each stage of the compressor and each heat exchanger means has an inlet and an outlet, a hollow support for said compressor and said heat exchanger means, said support including a partition and having first and second chambers disposed at the opposite sides of said partition and respectively interposed between the outlets of said first and second stages and the inlets of said second and next-following stages, said support further having first and second passages respectively interposed between the outlets of said first and second stages and said first and second chambers, said one heat exchanger means being connected between the outlet of one of said first and second stages and the respective passage.

2. The structure of claim 1, wherein said support further comprises first and second walls respectively separating said first and second passages from said first and second chambers.

3. The structure of claim 2, wherein said walls are remote from each other.

4. The structure of claim 1, wherein said support has first, second and third channels respectively communicating with the outlets of said first, second and next-following stages, said first and second channels being respectively located upstream of said first and second passages and said support further having an outlet opening communicating with said third channel.

5. The structure of claim 4, wherein the cross-sectional areas of said channels increase in the direction of flow of the fluid medium therethrough.

6. The structure of claim 5, wherein said support has a flange connected with said compressor and said channels have intake ends in said flange.

7. The structure of claim 1, wherein said support has a fluid-withdrawing aperture intermediate said second passage and said second chamber.

8. The structure of claim 1, further comprising conduit means interposed between the outlet of the other of said first and second stages and the respective passage.

9. The structure of claim 1, wherein said compressor is disposed at a level above said support.

10. The structure of claim 1, wherein said support has an outlet opening communicating with the outlet of said next-following stage, and further comprising aftercooler means receiving compressed fluid medium from said outlet opening.

* * * * *